United States Patent [19]

Hertell

[11] Patent Number: 4,772,185

[45] Date of Patent: Sep. 20, 1988

[54] ROTARY VANE PUMP HAVING A PLURALITY OF INLET AND OUTLET SLOTS IN A ROTATING SLEEVE

[75] Inventor: Siegfried Hertell, Radevormwald, Fed. Rep. of Germany

[73] Assignee: Barmag AG, Remscheid, Fed. Rep. of Germany

[21] Appl. No.: 934,663

[22] Filed: Nov. 25, 1986

[30] Foreign Application Priority Data

Nov. 27, 1985 [DE] Fed. Rep. of Germany ..... 3541907
Nov. 27, 1985 [DE] Fed. Rep. of Germany ..... 3541908

[51] Int. Cl.[4] ..... F04C 11/00; F04C 18/46

[52] U.S. Cl. ..... 418/3; 418/94; 418/172; 418/176; 418/186; 418/210

[58] Field of Search ..... 418/172, 176, 177, 88, 418/186, 187, 3, 94, 210

[56] References Cited

U.S. PATENT DOCUMENTS

| | | | |
|---|---|---|---|
| 1,253,460 | 1/1918 | Bodge | 418/176 |
| 1,886,206 | 11/1932 | Mandler | 418/172 |
| 2,430,251 | 11/1947 | Sharp | 418/172 |
| 4,451,215 | 5/1984 | Winkler et al. | 418/23 |
| 4,478,562 | 10/1984 | Schippers et al. | 418/88 |

FOREIGN PATENT DOCUMENTS

| | | |
|---|---|---|
| 0120993 | 11/1983 | European Pat. Off. . |
| 3506433 | 2/1985 | Fed. Rep. of Germany . |
| 2074247 | 10/1981 | United Kingdom . |

*Primary Examiner*—John J. Vrablik
*Assistant Examiner*—Leonard P. Walnoha
*Attorney, Agent, or Firm*—Bell, Seltzer, Park & Gibson

[57] ABSTRACT

A rotary vane vacuum pump assembly is disclosed which is characterized by the absence of the discharge of lubricating oil with the exhaust airstream, and which includes an internal stator and a surrounding rotor. Pivotal vanes are mounted on the interior of the rotor, so as to define a plurality of air chambers which expand and contract as the rotor rotates about the stator. Also, a freely rotatably cylindrical sleeve is positioned between the stator and vanes, so that the relative sliding contact of the vanes on the surface of the sleeve is minimized, to thereby eliminate the need for internal oil lubrication. In one preferred embodiment, a hydraulic pump is joined to the vacuum pump to form a compact assembly, and wherein the hydraulic pump supplies oil to the bearings which mount the rotor.

14 Claims, 3 Drawing Sheets

ROTARY VANE PUMP HAVING A PLURALITY OF INLET AND OUTLET SLOTS IN A ROTATING SLEEVE

BACKGROUND OF THE INVENTION

The present invention relates to a rotary vane pump assembly of the type adapted to provide a partial vacuum for operation various automobile accessories. A pump of this general type is disclosed in U.S. Pat. No. 4,451,215 and published UK Patent Application GB No. 2,074,247.

German patents OS Nos. 30 14 519 and 30 14 520 disclose rotary vane vacuum pumps, wherein a freely rotatable sleeve is disposed on the inner periphery of the outer housing. The use of such a sleeve permits the sliding speed of the ends of the vanes to be substantially reduced, and the reduced sliding speed permits the usual oil lubrication to be omitted, and as a result, the exhaust air is substantially free of oil. This design however cannot be used for the so-called external rotor type pumps, wherein the housing forms both the vane carrier and the rotor, and eccentrically encloses the stator, because in this instance the supply and/or discharge lines normally would be located in the stator and terminate on its circumferential surface, and the presence of a rotatable sleeve on the stator would block the openings of the supply and discharge lines.

Vacuum pumps are often employed to assist the braking power and to operate other accessories in motor vehicles having Diesel engines or Otto injection engines, and these vacuum pumps are commonly of the rotary vane type. It is also recognized that other components of the automobile, such as lubricating oil pumps, hydraulic pumps, or electric generators are needed for the operation of the vehicle. All of these accessories are driven by the engine of the motor vehicle, and it is difficult to accommodate all of these accessories in the engine compartment by reason of limited space, and in addition, the drives are ditticult to connect to the engine because of space limitations. Problems also arise with respect to the supply of lubricating oil to these accessories, since lubricating oil must be both supplied and discharged. Further, the operation of a rotary vane vacuum pump having an internal oil lubrication system can present problems, since the lubricating oil must be prevented from exiting with the exhaust air into the atmosphere where it may contact adjacent accessories. In particular, in the case of an electric generator, it is absolutely necessary to avoid any contact with such lubricating oil.

It is accordingly an object of the present invention to provide a rotary vane pump of the external rotor type, which does not require an internal oil lubrication system, and so that the air output is substantially oil free.

It is also an object of the present invention to provide a rotary vane pump assembly which comprises a unitary structure composed of a rotary vane vacuum pump and another machine, such as an automobile accessory, and wherein the structural assembly is compact and requires only one common drive connection from the engine.

SUMMARY OF THE INVENTION

These and other objects and advantages of the present invention are achieved in the embodiments described herein by the provision of a rotary vane pump which comprises a supporting post defining a central axis, a stator fixedly mounted to the post and which is eccentrically mounted with respect to the central axis, and a cylindrical sleeve coaxially mounted to the stator for free rotation about the axis of the stator. A rotor is mounted for rotation about the post and encloses the stator, and the rotor includes an inside surface opposing the cylindrical sleeve, and an outside surface which is coaxially disposed about the central axis and is adapted to be rotatably driven by a drive belt or the like. A plurality of vanes are pivotally mounted to the inside surface of the rotor, and each of the vanes includes an end portion engaging the cylindrical sleeve to divide the space between the cylindrical sleeve and the inside surface into a plurality of separated chambers which rotate about the stator upon rotation of the rotor. Also, the chambers expand during their rotation about one portion of the periphery of the stator and contract during rotation about a second portion of the periphery of the stator. In addition, the rotary vane pump includes inlet air passageway means for delivering air to the chambers during expansion thereof, and outlet air passageway means for exhausting air from the chambers during contraction thereof. Preferably, each of the end portions of the vanes slideably engages the cylindrical sleeve, and each of the vanes is biased into engagement with the sleeve by a spring.

As a further aspect of the present invention, a central shaft may be provided which extends coaxially through the post and which is rotable with respect to the post, and a rotary machine means may be provided which includes a machine element which is fixedly mounted to the shaft so as to rotate therewith. In a preferred embodiment, a mounting flange is provided which is fixed to the post and positioned at right angles to the central axis, and the rotary machine means is fixedly mounted to the flange on the side thereof opposite the post, and with the shaft extending through the flange. The rotary machine means may be designed as a fluid pump, in which event it includes a housing mounted to the flange, and the machine element comprises a gear positioned in the housing. The gear is engaged by further gear means positioned in the housing, and the housing includes an inlet duct and an outlet duct extending therethrough, whereby rotation of the shaft is adapted to pump a fluid through the housing.

In the latter embodiment, the rotor of the rotary vacuum pump may take the place of a drive pulley in an automobile, which may be needed in any event. Also, the belt drive simultaneously drives both the rotary vacuum pump and the rotary machine means. A particularly compact assembly is thereby obtained, which may be mounted to the engine of the motor vehicle by the mounting flange.

Where the rotary machine means is in the form of a hydraulic oil pump, it may be designed to assist the steering of the motor vehicle. In addition, the bearing between the shaft and post of the rotary vacuum pump may be connected via a passageway extending through the shaft to the oil pump, so that the bearing of the rotary vacuum pump is lubricated with oil.

As indicated above, it must be expected that any oil which enters the interior of a rotary vane vacuum pump will be discharged with the exhaust air. To prevent this, the present invention provides a construction which permits the interior of the rotary vane vacuum pump to be operated without oil lubrication. To this end, the post includes on its front end an annular recess which surrounds the supporting shaft and accommodates a seal. This seal serves to seal the bearing area from the interior of the rotor housing. Thus, this embodiment provides that the bearing of the rotary vane vacuum pump may be lubricated with oil, while the remaining portion of the pump is designed and constructed for dry operation. More particularly, this advantage is achieved in the present invention by the provision of the cylindrical sleeve which freely rotates about the stator, and such that the end portions of the vanes which contact the sleeve have only a relatively small relative movement with respect to the sleeve, and as a result the oil lubrication may be omitted. The sleeve itself may be supported by a suitable sleeve bearing, such as an air bearing or an anti-friction bearing of the type comprising a plurality of needle bearings having a grease lubricated cage. Such a design permits the operation of the pump without a supply of a lubricant, typically for several thousand hours.

In the preferred embodiment, the inlet air passageway means and the outlet air passageway means are both located so as to extend through the supporting post and the stator, and both terminate on the surface of the stator at circumferentially spaced apart locations. The rotatable sleeve includes a number of narrow inlet slots extending in the circumferential direction and disposed in alignment with the inlet opening, and the sleeve also includes a number of narrow outlet slots extending in the circumferential direction and aligned with the outlet opening. These slots connect the interior of the pump with the suction air and the exhaust air, respectively. Viewed in the circumferential direction, these slots are sufficiently narrow so that a short circuit does not occur between successive chambers which are defined by the vanes. Preferably, the width of the slots is limited in the circumferential direction so that the vanes rest on the slots with a positive coverage.

BRIEF DESCRIPTION OF THE DRAWINGS

Some of the objects and advantages of the present invention having been stated, others will appear as the description proceeds, when considered in conjunction with accompanying drawings, in which—

DETAILED DESCRIPTION OF THE PREFERRED EMBODIMENTS

Figure 1:
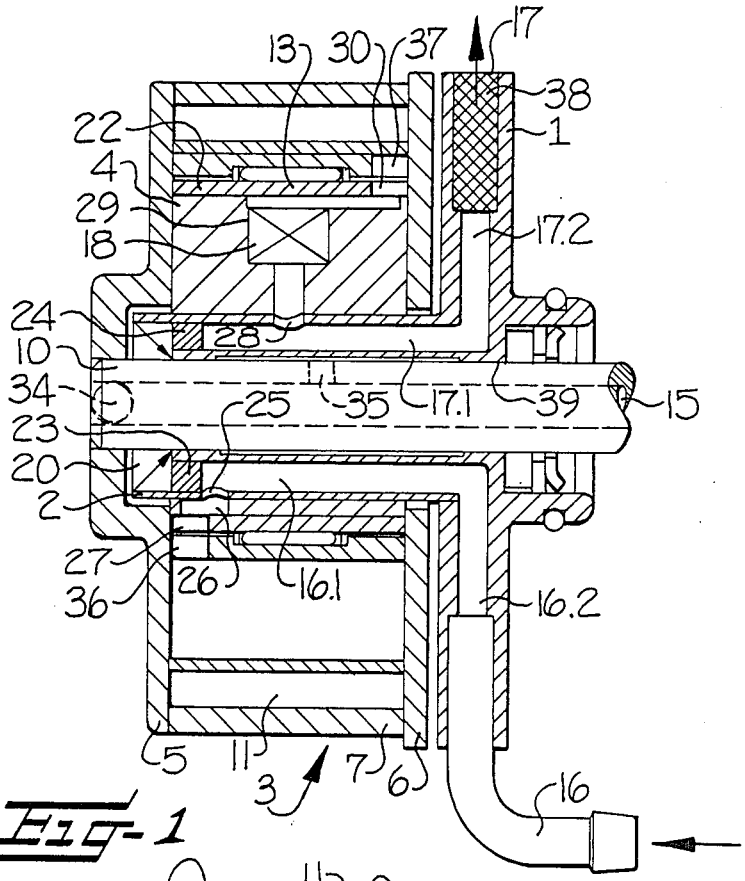
FIG. 1 is a sectional side elevation view of a rotary vane pump in accordance with one embodiment of the present invention.

Referring more particularly to the drawings, FIG. 1 illustrates a rotary vane pump which is adapted for generating a partial vacuum, and which comprises a supporting flange 1 which mounts a cylindrical post 2 extending outwardly from one side of the flange, and with the post 2 defining a central axis which is perpendicular to the flange. A stator 4 is fixedly mounted to the post, and the stator has a cylindrical outer surface which defines an axis which is offset from and parallel to the central axis of the post 2.

Figure 2:
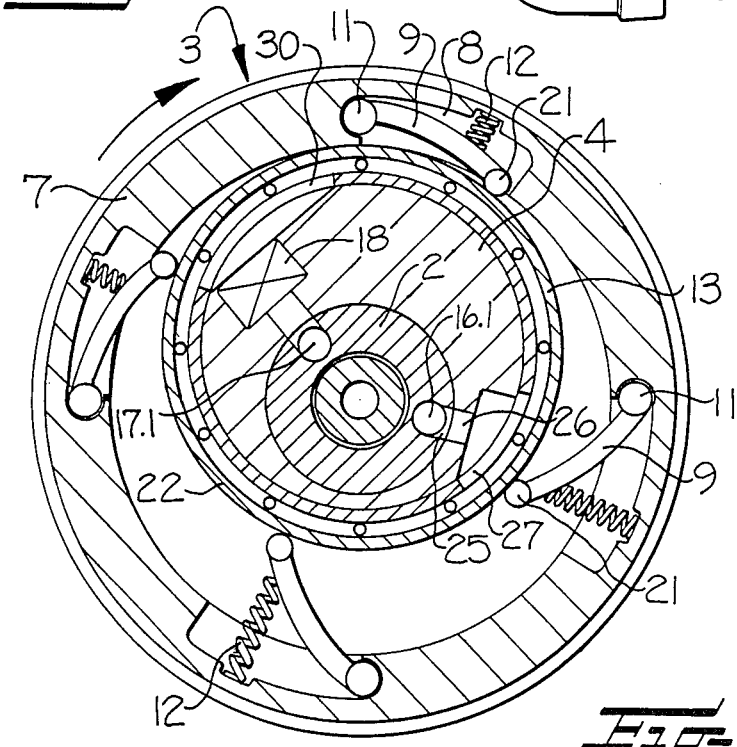
FIG. 2 is a sectional view taken substantially along the line 2—2 of FIG. 1.
Figure 3:
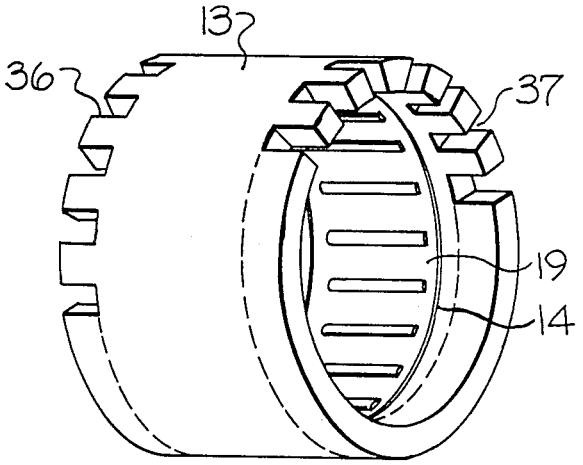
FIG. 3 is a perspective view of the rotatable cylindrical sleeve of the present invention.

As best seen in FIGS. 2 and 3, a cylindrical sleeve 13 is coaxially mounted to the stator for free rotation about the axis of the stator. Also, a rotor 3 is provided which is mounted for rotation about the post and which encloses the stator, and the rotor 3 has a cylindrical outer wall 7 which is coaxially disposed about the central axis. The outer wall 7 includes an inside surface which opposes the cylindrical sleeve, and an outside surface which is adapted to be rotatably driven by a drive belt or the like. The rotor 3 further includes a pair of axially separated flanges 5 and 6 which enclose the stator 4 in the axial directions, with the flange 5 being fixedly mounted to a shaft 10.

The shaft 10 extends through the supporting post 2 along the central axis, and the supporting post 2 is rotatably mounted upon the shaft by the journal bearing surfaces 39. A lubricant passageway extends through the shaft 10 for supplying lubricant to the bearing surfaces 39, and the passageway includes an axial bore 15 and a radial bore 35 in the shaft 10.

The cylindrical sleeve 13 includes an annular interior groove 14 located medially along its axial length, and the groove 14 supports the cage of a needle roller bearing assembly 19. In addition, an armored ring 22 is fixedly mounted to the stator 4, and such that the needles of the assembly 19 roll upon the armored ring 22.

The inside surface of the outer wall 7 includes a plurality of circumferentially spaced apart recesses 8, and each recess receives a vane 9 which is pivotally mounted to the wall 7 at 11. Each of the vanes includes an end portion 21 which slideably engages the cylindrical sleeve 13, to thereby divide the space between the cylindrical sleeve and the inside surface into a plurality of separated chambers which rotate about the stator upon rotation of the rotor 3. The vanes are biased inwardly by the springs 12, and the vanes are totally received in the recesses 8 of the outer wall 7 in their extreme pivoted position. The axial length of the end portions 21 of the vanes equals the axial length of the stator, which is also equal to the axial length between the rotor flanges 5 and 6. The free ends 21 slide on the sleeve 13, which is freely rotatable with respect to the stator.

As seen in FIGS. 1 and 2, the stator 4 is eccentrically supported to a degree such that the sleeve 13 defines a very small sealing gap with the inside surface of the outer wall 7 and as shown in the upper portion of FIG. 2. As a result of this arrangement, the sleeve 13 forms a crescent-shaped space within the housing, which is divided by the vanes 9 into the individual chambers, which increase in size and then decrease in size as the rotor rotates.

The rotary vane pump further includes inlet air passageway means for delivering air to the chambers during the expansion thereof, and outlet air passageway means for exhausting air from the chambers during the contraction thereof. The inlet air passageway means includes the inlet line 16, a radial duct 16.2 extending through the flange 1, and an axial bore 16.1 in the post 2. The end of the bore 16.1 at the free end of the post 2 is closed by a sealing plug 23, and the bore 16.1 communicates with a radial opening 25 and a recess 26 in the stator 4 and an inlet opening 27 in the armoured ring 22. It should be noted that the inlet opening 27 may extend over a relatively elongate portion of the circumference of the armoured ring 22, as best seen in FIG. 2, and it defines the suction side of the rotor interior.

Figure 4:
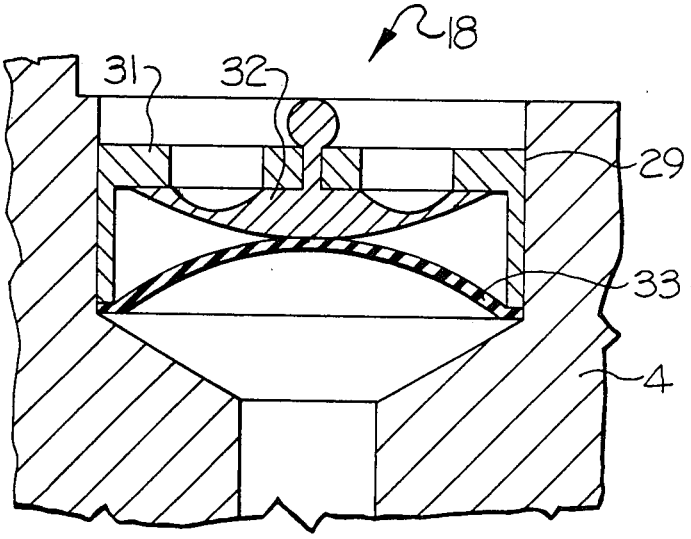
FIG. 4 is an enlarged sectional view of the exhaust valve utilized in the pump of FIG. 1.

The outlet air passageway means includes the radial duct 17.2 in the flange and which leads to the outlet 17, and the outlet duct 17.2 is connected to the axial bore 17.1 in the post 2. The bore 17.1 is closed at the free end of the post by a plug 24, and it communicates with a radial opening 28 in the post 2, a radial bore and recess 29 in the stator 4, and the outlet 30 in the armoured ring 22. Similarly, the outlet 30 in the ring 22 may extend over a relatively elongate portion of the circumference of the ring, and it defines the discharge side of the rotor interior. A one-way return valve 18 is positioned in the recess 29 of the stator 4, which is shown in more detail in FIG. 4. The valve 18 includes a perforated plate 31, a dome-shaped plate 32 covering the apertures of the plate 31, and an elastic support plate 33 which permits the plate 32 to pivot and thereby open the valve.

Referring again to FIG. 3, it will be seen that the sleeve 13 is provided with a plurality of circumferentially spaced apart inlet slots 36 along one side edge, and a plurality of circumferentially spaced apart outlet slots 37 on its other edge. These slots 36 and 37 are aligned respectively with the opening 27 in the ring 22 and the discharge opening 30 in the ring 22. It should also be noted that the sleeve 13 is closely adjacent the surface of the ring 22 on both sides of the needle bearing, leaving a very small sealing gap, which is only sufficient to insure its free rotation. In this regard, sealing strips (not shown) may be provided for additional sealing, which may be arranged circumferentially between the sleeve 13 and the ring 22, and also axially on both sides of the inlet opening 27 and the discharge opening 30 of the ring 22.

As noted above, the end portions 21 of the vanes and the slots 36, 37 are so dimensioned in the circumferential direction so that no short circuit occurs between the chambers via the slots. To this end, the end portions 21 are substantially the same width in the circumferential direction as the slots. Preferably, there is a positive coverage of the slots 36, 37 by the end portions 21 of the vanes.

A lubricating oil may be delivered by an oil pump to the bore 15 of the shaft 10. The free end of the shaft 10 is closed by a ball 34, and a seal 20 is positioned between the free end of the shaft 10 and a recess in the free end of the post 2. The seal 20 thus prevents leakage of the lubricating oil from the bearing surfaces 39 into the interior of the rotor 3, and thus the risk of having lubricating oil reach the exhaust air is effectively eliminated.

In operation, a drive motor, such as the engine of an automobile, powers the rotary vane pump via a drive belt, which loops partially around the outer wall 7 of the rotor 3. To this end, the rotor 3 is supported on the shaft 10, with the advantage that owing to the small diameter of the outer wall 7, the relative speed between the shaft 10 and bearing surfaces 39 is low. As the rotor 3 rotates, the vanes 9 perform a pivotal motion about the axes 11, and the springs 12 press the vanes radially inwardly, so that the end portions 21 slide on the sleeve 13, which itself freely rotates on the stator 4.

It should be noted that a one-way valve which opens in the direction of the suction may be positioned in the recess 26 of the stator. During rotation of the rotor, a suction pressure develops on the suction side, and as a result, air is drawn into the expanding chamber through the inlet slots 36 of the sleeve 13 and which are aligned with the inlet opening 27. Similarly, on the discharge side, the air is delivered through the outlet slots 37 of the sleeve 13, and through the outlet opening 30 in the ring 22 and into the air discharge ducts 17.1 and 17.2. A filter 38 may be disposed at the end of the air discharge duct 17.2.

The sleeve 13 may be brought to rotation by the vanes 9, with an average relative speed being reached. Thus the end portions 21 have only a slight relative motion relative to the sleeve, and for this reason, no lubrication is required. With respect to the needle bearing 19 of the sleeve, the permanent lubrication provided by the manufacturer will normally suffice to insure a sufficiently long service life. Further, the present invention permits the journal bearing surfaces 39 to be effectively lubricated with oil, without risk of the oil entering the rotor housing.

Figure 5:
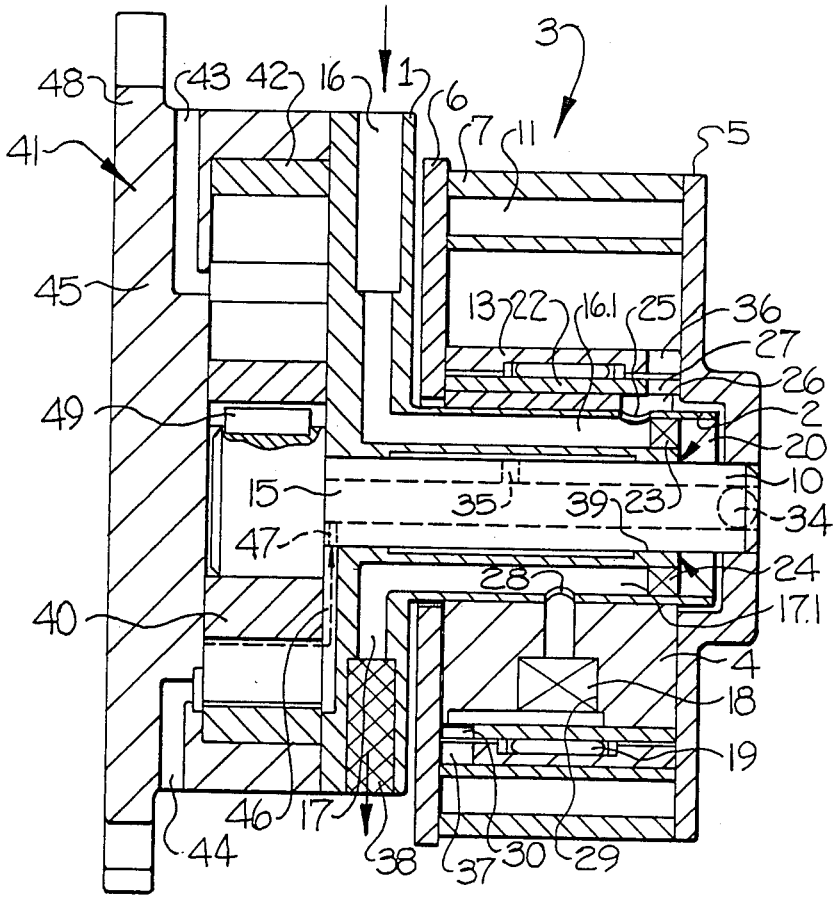
FIG. 5 is a sectional side elevation view of a rotary pump assembly in accordance with a second embodiment of the present invention.

Referring now to the embodiment of FIG. 5, wherein like numerals designate corresponding components with the above embodiment, there is provided a rotary vane pump assembly which includes a rotary vane vacuum pump substantially as described above with respect to FIGS. 1–4, together with a hydraulic pump which is formed with the vacuum pump as a unitary structural assembly. More particularly, the shaft 10 extends through the mounting flange 1, and mounts a driving gear or pinion 40 of an internal gear pump 41 and which is adapted to serve as a hydraulic pump. The pump is an internal gear pump of conventional design, and includes the pinion 40 and an internal gear 42. The pump includes a housing 45 which is bolted to the side of the flange 1 opposite the vacuum pump, and the housing includes a pump inlet at 43 and an outlet at 44.

A radial oil lubricating groove 46 leads from the discharge side of the pump, and the groove is aligned with a radial bore 47 in the shaft 10. The radial bore 47 in turn leads to the longitudinal bore 15 in the shaft 10. By this arrangement, the oil may be delivered to the bearing surfaces 39 in the manner described above, and the seal 20 serves to prevent the oil from entering the interior of the rotor 3. The described lubrication system results in an intermittent supply of oil to the bearing surfaces 39, and if desired, a suitable groove (not shown) may be provided for the return flow of oil from the bearing surfaces 39 to the intake side of the oil pump. The oil requirement of the bearing surfaces 39 is very low, and is limited by reason of the small cross section of the radial bore 47 as well as the fact that the radial bore is only intermittently connected with the groove 46.

The structural assembly as illustrated in FIG. 5 may be mounted by means of a flange 48 on the housing 45, to the engine of the vehicle, or elsewhere in the engine compartment. The drive may be accomplished by a belt which loops partially about the outer surface of the rotor 3, which serves as a belt pulley. The air intake 16 may be connected with an accessory of the automobile, such as the power brake amplifier. Also, it is preferable that a filter or screen 38 be inserted in the discharge line 17, which exhausts to the atmosphere.

In addition to being connected to the bearings 39 of the vacuum pump, the oil pump may also be connected with an oil circulation system, such as a servo amplifier associated with the power steering. The structural assembly as illustrated distinguishes itself by its dimensional and functional compactness, and it is of particular significance that the operative connection to the engine may be made only through the drive of the rotor of the vacuum pump. Otherwise, the assembly is independent and it does not require any lubrication by the motor vehicle engine. Similarly, the discharge of the exhaust air is independent of the motor vehicle engine, and it does not result in any contamination of other accessories. Further, despite its characteristic of being designed for dry operation, provision is made for the proper lubrication of the bearing in the vacuum pump and consequently, a long service life may be obtained.

In the drawings and specification, there has been set forth a preferred embodiment of the invention, and although specific terms are employed, they are used in a generic and descriptive sense only and not for purposes of limitation.

That which I claim is:

1. A rotary vane pump adapted for use in generating a partial vacuum, and comprising a supporting post defining a central axis, a stator fixedly mounted to said post, said stator having a cylindrical outer surface which defines an axis which is offset from and parallel to said central axis, a cylindrical sleeve coaxially mounted to said stator for free rotation about the axis of said stator, a rotor coaxially disposed about said central axis and mounted for rotation and adapted to be rotatably driven about said post and enclosing said stator, said rotor having an outside cylindrical surface and an inside surface opposing said cylindrical sleeve, a plurality of vanes pivotally mounted to said inside surface, with each of said vanes including an end portion engaging said cylindrical sleeve to divide the space between said cylindrical sleeve and said inside surface into a plurality of separated chambers which rotate about said stator upon rotation of said rotor, and such that said chambers expand during their rotation about one portion of the periphery of said stator and contract during rotation about a second portion of the periphery of said stator, inlet air passageway means for delivering air to said chambers during expansion thereof, and extending through said post, said stator, and said cylindrical sleeve, outlet air passageway means for exhausting air from said chambers during the contraction thereof, and extending through said cylindrical sleeve, said stator, and said post, and wherein one of said inlet and said outlet air passageway means comprises a radial air opening on the outer periphery of said stator, and a plurality of circumferentially spaced apart slots extending through said cylindrical sleeve, with said slots extending about the periphery of said sleeve and being aligned with said air opening.

2. The rotary vane pump as defined in claim 1 wherein the other of said inlet and said outlet air passageway means includes a second radial air opening on the outer periphery of said stator and which is axially spaced from said first mentioned radial air opening, and a plurality of circumferentially spaced apart second slots extending through said cylindrical sleeve, and with said second slots extending about the periphery of said sleeve and being aligned with said second air opening.

3. The rotary vane pump as defined in claim 2 wherein said first mentioned slots communicate with one side edge of said cylindrical sleeve, and said second slots communicate with the other side edge of said cylindrical sleeve.

4. The rotary vane pump as defined in claim 3 wherein said cylindrical sleeve includes needle bearing means disposed between the medial portion of said sleeve and said stator, and wherein said first mentioned and said second slots are positioned on respective opposite sides of said needle bearing means.

5. The rotary vane pump as defined in claim 1 further comprising a shaft extending through said supporting post along said central axis and being rotatably mounted with respect to said supporting post and said stator, and wherein said rotor is fixedly mounted to one end of said shaft.

6. The rotary vane pump as defined in claim 5 further comprising bearing surface means between said shaft and said supporting post to facilitate relative rotation therebetween, and lubricant passageway means extending through said shaft to said bearing surface means for supplying lubricant thereto.

7. The rotary vane pump as defined in claim 5 further comprising a mounting flange extending adjacent one side of said rotor, with said supporting post being fixedly mounted to said flange, and wherein the other end of said shaft extends through said flange.

8. The rotary vane pump as defined in claim 1 wherein said end portions of said vanes slideably engage said cylindrical sleeve, and each of said vanes include means for biasing its associated end portion into engagement with said sleeve.

9. A rotary vane pump assembly comprising a supporting post defining a central axis, a stator fixedly mounted to said post, said stator having a cylindrical outer surface which defines an axis which is offset from and parallel to said central axis, a shaft extending through said post and along said central axis, with said shaft being rotatably mounted with respect to said post and said stator, a cylindrical sleeve coaxially mounted ot said stator for free rotation about the axis of said stator, a rotor fixedly mounted to said shaft for rotation about said post and said stator, said rotor having an outside surface which is adapted to be rotatably driven by a drive belt or the like and which is coaxially disposed about said central axis, and an inside surface facing said stator, rotary vane means operatively mounted to said inside surface and between said rotor and said cylindrical sleeve for dividing the space between said rotor and said cylindrical sleeve into a plurality of separated chambers which rotate about said stator during rotation of said rotor, and such that the chambers expand during rotation about one portion of the periphery of said stator and contract during rotation about a second portion of the periphery of said stator, inlet air passageway means for delivery air to said chambers during expansion thereof, and extending through said post, said stator, and said cylindrical sleeve, outlet air passageway means for exhausting air from said chambers during the contraction thereof, and extending through said cylindrical sleeve, said stator, and said post, and wherein one of said inlet and said outlet air passageway means comprises a radial air opening on the outer periphery of said stator, and a plurality of circumferentially spaced apart slots extending through said cylindrical sleeve, with said slots extending about the periphery of said sleeve and being aligned with said air opening, and rotary machine means and including a machine element which is fixedly mounted to said shaft so as to rotate therewith.

10. The rotary vane pump assembly as defined in claim 9 further comprising a flange fixedly mounted to said post and positioned at right angles to said central axis, and wherein said rotary machine means is fixedly mounted to said flange on the side thereof opposite said post, and wherein said shaft extends through said flange.

11. The rotary vane pump assembly as defined in claim 10 wherein said rotary machine means includes a housing mounted to said flange, and said machine element of said rotary machine means comprises a gear positioned in said housing, and said rotary machine means further includes cooperating gear means positioned in said housing and an inlet duct and an outlet duct extending through said housing, and whereby said rotary machine means is adapted to pump a fluid therethrough upon rotation of said shaft.

12. The rotary vane pump assembly as defined in claim 11 further including bearing surface means between said shaft and said supporting post to facilitate relative rotation therebetween, and lubricant passageway means extending from a location adjacent said outlet duct of said rotary machine means, through the interior of said shaft, and to said bearing surface means, whereby when said rotary machine means serves to pump oil, a portion of the oil may be directed through said lubricant passageway means to said bearing surface means.

13. The rotary vane pump assembly as defined in claim 9 wherein said rotary vane means comprises a cylindrical sleeve coaxially mounted to said stator for free rotation about the axis of said stator, and a plurality of vanes pivotally mounted to said inside surface, with each of said vanes including an end portion engaging said cylindrical sleeve, and such that said end portion of each vane slideably engages said sleeve.

14. The rotary vane pump assembly as defined in claim 9 wherein the other of said inlet and said outlet air passageway means includes a second radial air opening on the outer periphery of said stator and which is axially spaced from said first mentioned radial air oening, and a plurality of circumferentially spaced apart second slots extending through said cylindrical sleeve, and with said second slots extending about the periphery of said sleeve and being aligned with said second air opening.

* * * * *